US008240149B2

(12) United States Patent
Lehar et al.

(10) Patent No.: US 8,240,149 B2
(45) Date of Patent: Aug. 14, 2012

(54) ORGANIC RANKINE CYCLE SYSTEM AND METHOD

(75) Inventors: Matthew Alexander Lehar, Munich (DE); Sebastian W. Freund, Unterföhring (DE); Giacomo Seghi, Bardalone (IT)

(73) Assignee: General Electric Company, Niskayuna, NY (US)

( * ) Notice: Subject to any disclaimer, the term of this patent is extended or adjusted under 35 U.S.C. 154(b) by 751 days.

(21) Appl. No.: 12/436,269

(22) Filed: May 6, 2009

(65) Prior Publication Data

US 2010/0281865 A1 Nov. 11, 2010

(51) Int. Cl.
*F01K 7/34* (2006.01)
*F02C 6/00* (2006.01)

(52) U.S. Cl. ..... 60/653; 60/39.182; 60/618

(58) Field of Classification Search ..... 60/618, 60/39.182, 653, 670
See application file for complete search history.

(56) References Cited

U.S. PATENT DOCUMENTS 3,992,876 A * 11/1976 Aguet ..... 60/39.12
4,099,374 A * 7/1978 Foster-Pegg ..... 60/39.12
5,437,157 A 8/1995 Bronicki
5,555,731 A 9/1996 Rosenblatt
6,167,706 B1 1/2001 Bronicki et al.
6,266,953 B1 * 7/2001 Ramstetter et al. ..... 60/783
6,539,718 B2 4/2003 Bronicki et al.
6,874,322 B2 * 4/2005 Schwarzott ..... 60/772
6,920,760 B2 * 7/2005 Schottler et al. ..... 60/772
2004/0128976 A1 * 7/2004 Gralla ..... 60/39.182
2007/0130952 A1 * 6/2007 Copen ..... 60/772

OTHER PUBLICATIONS

Hank Leibowitz and Daniel N. Schochet ; "Generating Electric Power From Compressor Station Residual Heat"; Downloaded from Internet:<http://www.oildom.com/PGJ/pgjarchive/Nov01/generating.pdf>; 2 Pages.

* cited by examiner

*Primary Examiner* — Hoang Nguyen
(74) *Attorney, Agent, or Firm* — Andrew J. Caruso

(57) ABSTRACT

An ORC system configured to limit temperature of a working fluid below a threshold temperature is provided. The ORC system includes a heat source configured to convey a waste heat fluid. The ORC system also includes a heat exchanger coupled to the heat source. The heat exchanger includes an evaporator configured to receive the waste heat fluid from the heat source and vaporize the working fluid, wherein the evaporator is further configured to allow heat exchange between the waste heat fluid and the vaporized working fluid at an elevated temperature and further produce an evaporator outlet flow including a lower temperature waste heat fluid. The heat exchanger also includes a superheater configured to receive the lower temperature waste heat fluid from the evaporator, wherein the superheater is further configured to allow heat exchange between the lower temperature waste heat fluid and a relatively higher temperature working fluid contained in the superheater and further produce a superheater outlet flow comprising an elevated temperature waste heat fluid. The heat exchanger further includes a preheater configured to receive the elevated temperature waste heat fluid from the superheater and allow heat exchange with a relatively lower temperature working fluid in a liquid state contained in the preheater.

18 Claims, 3 Drawing Sheets

ORGANIC RANKINE CYCLE SYSTEM AND METHOD

CROSS REFERENCE TO RELATED APPLICATIONS

This application is related to the following co-pending U.S. patent application Ser. No. 12/436,277, entitled "An Improved Organic Rankine Cycle System and Method" assigned to the same assignee as this application and filed herewith, the entirety of which is incorporated by reference herein.

BACKGROUND

The invention relates generally to organic rankine cycle (ORC) systems, and more particularly to an economical system and method for the same.

With the advent of the energy crisis and, the need to conserve and more effectively use our available energies, rankine cycle systems have been used to capture the so called "waste heat," that was otherwise being lost to the atmosphere and, as such, was indirectly detrimental to the environment by requiring more fuel for power production than necessary.

Common sources of waste heat that are presently being discharged to the environment are geothermal sources and heat from other types of engines such as gas turbine engines, that give off significant heat in their exhaust gases, and reciprocating engines, that give off heat both in their exhaust gases and to cooling liquids such as water and lubricants.

In general, ORC systems have been deployed as retrofits for small and medium-scale gas turbines, to capture from the waste heat gas stream desirable power output. A working fluid used in such cycles is typically a hydrocarbon at about atmospheric pressure. However, the working fluid may degrade beyond a critical temperature, such as, but not limited to, 500 deg C. In a gas turbine system, the temperature of the exhaust is comparable to such high temperatures and hence, there is a reasonable probability of degradation of the working fluid due to direct exposure to the waste heat gas from the exhaust.

In order to avoid the aforementioned issue, an intermediate thermal fluid system is generally used to convey heat from the exhaust to an organic Rankine cycle boiler. In an example, the fluid is oil. However, the intermediate thermal fluid system represents up to about one-quarter of the cost of the complete ORC. Furthermore, the intermediate thermal fluid system and heat exchangers require a higher temperature difference resulting in an increase in size and a lowering of the overall efficiency.

Therefore, an improved ORC system is desirable to address one or more of the aforementioned issues.

BRIEF DESCRIPTION

In accordance with an embodiment of the invention, an ORC system configured to limit temperature of a working fluid below a threshold temperature is provided. The ORC system includes a heat source configured to convey a waste heat fluid. The ORC system also includes a heat exchanger coupled to the heat source. The heat exchanger includes an evaporator configured to receive the waste heat fluid from the heat source and vaporize the working fluid, wherein the evaporator is further configured to allow heat exchange between the waste heat fluid and the vaporized working fluid and produce an evaporator outlet flow comprising a lower temperature waste heat fluid. The heat exchanger also includes a superheater configured to receive the lower temperature waste heat fluid from the evaporator and is further configured to allow heat exchange between the lower temperature waste heat fluid and a relatively higher temperature working fluid contained in the superheater and further produce a superheater outlet flow comprising an elevated temperature waste heat fluid. The heat exchanger further includes a preheater configured to receive the elevated temperature waste heat fluid from the superheater and allow heat exchange with a relatively lower temperature working fluid in a liquid state contained in the preheater.

In accordance with another embodiment of the invention, a method for limiting temperature of a working fluid below a threshold temperature in an ORC is provided. The method includes introducing waste heat fluid into a heat exchanger, wherein the heat exchanger includes an evaporator, a superheater and a preheater. The method also includes conveying the waste heat fluid into the evaporator to promote heat exchange between the waste heat fluid and the working fluid at an elevated temperature vaporized within the evaporator to produce an evaporator outlet flow including a lower temperature waste heat fluid. The method also includes conveying the lower temperature waste heat fluid from the evaporator to a superheater to promote heat exchange between the lower temperature waste heat fluid and a relatively higher temperature working fluid contained in the superheater and further producing a superheater outlet flow including an elevated temperature waste heat fluid. The method further includes conveying the elevated temperature waste heat fluid from the superheater to a preheater to promote heat exchange with a relatively lower temperature working fluid in a liquid state contained in the preheater.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As discussed in detail below, embodiments of the invention include an organic rankine cycle (ORC) system and method to limit the temperature of a working fluid within the system, below a threshold temperature. In one embodiment, the system and method provide a waste heat fluid that flows into various sections of a heat exchanger to enable optimal heat exchange between the waste heat fluid and the working fluid thereby avoiding overheating of the working fluid. In another embodiment, the heat exchanger includes external and internal enhancement features to provide optimal heat exchange between the waste heat fluid and the working fluid. It should be noted that both the embodiments may also be employed in conjunction with each other. As used herein, the term 'threshold temperature' refers to temperatures in a range between about 250 to about 350 deg C.

Figure 1:
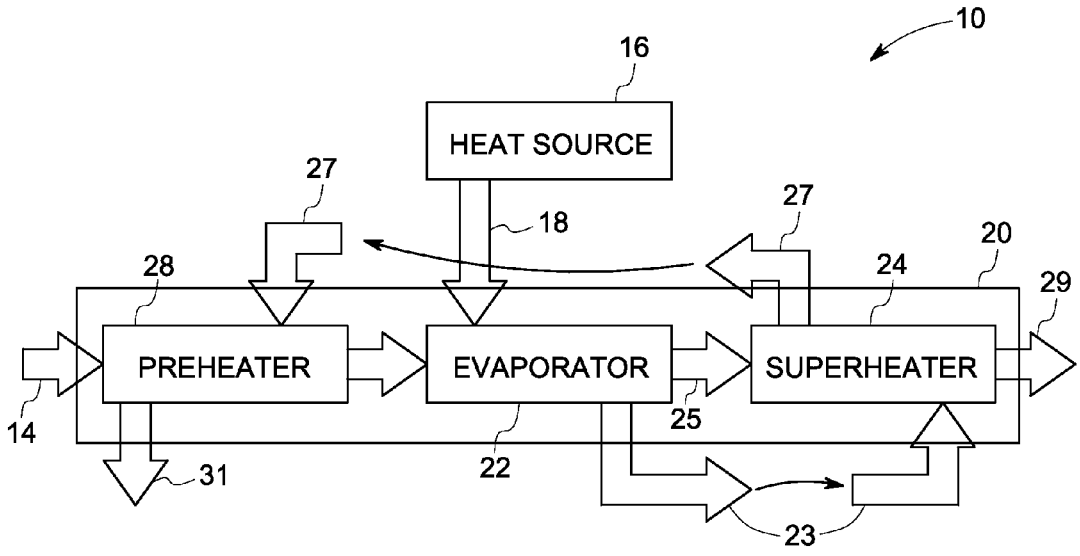
FIG. 1 is a schematic illustration of an ORC system configured to limit temperature of a working fluid below a threshold temperature in accordance with an embodiment of the invention.

Turning to the drawings, FIG. 1 is a schematic illustration of an organic rankine cycle (ORC) system 10 configured to limit the temperature of a working fluid 14 below a threshold temperature. The system 10 includes a heat source 16 that conveys a waste heat fluid 18 at a temperature, for example, between about 400 to about 600 deg C. A heat exchanger 20 is coupled to the heat source 16 and is configured to facilitate heat exchange between the working fluid 14 and the waste heat fluid 18 in a manner that does not overheat the working fluid 14, as will be discussed in greater detail below. The heat exchanger 20 includes an evaporator 22 that receives an inflow of the working fluid 14 and vaporizes the working fluid 14. The evaporator 22 receives the waste heat fluid 18 from the heat source 16 and promotes heat exchange between the waste heat fluid 18 and the vaporized working fluid 15 that is at a relatively lower temperature, for example between about 150 deg C. to about 300 deg C. and produces an evaporator outlet flow including a lower temperature waste heat fluid 23 and an elevated temperature working fluid 25. In one embodiment, the temperature of the elevated temperature working fluid 25 exiting the evaporator 22 is about 230 deg C. In another exemplary embodiment, the waste heat fluid 18 and the working fluid 25 are in parallel flow configuration in the evaporator 22. The term 'parallel flow configuration' refers to heat being transferred from an inlet of the heat source 16 to an inlet of the evaporator 22 and likewise, from an outlet of the heat source 16 to an outlet of the evaporator 22.

The evaporator outlet flow from the evaporator 22 is conveyed to a superheater 24. The superheater 24 further heats the elevated temperature working fluid 25 to produce a working fluid 29 at a relatively higher temperature within the heat exchanger 20 compared to the temperatures of the working fluid at the evaporator 22 and a preheater 28. The superheater 24 promotes heat exchange between the relatively higher temperature working fluid 29 and the lower temperature waste heat fluid 23 to produce a superheater outlet flow including an elevated temperature waste heat fluid 27. It should be noted that the waste fluid 18 directly from the heat source 16 is at a higher temperature compared to the lower temperature waste heat fluid 23 entering the superheater 24. Hence, by allowing the waste heat fluid 18 to enter the evaporator 22 prior to entering the superheater 24, the contact of a relatively higher temperature working fluid 29 contained in the superheater 24 with the waste fluid 18 from the heat source 16 that is also at a relatively higher temperature is avoided. Thus, a potential degradation of the film of the working fluid due to contact with the relatively higher temperature waste fluid 18 from the heat source 16 is eliminated.

The elevated temperature waste heat fluid 27 exits from the superheater 24 and is conveyed to the preheater 28. In one embodiment, temperature of the elevated temperature waste heat fluid 27 exiting the superheater is between about 375 to about 425 deg C. The preheater 28 contains a relatively lower temperature working fluid 29 in a liquid state and promotes heat exchange between the relatively lower temperature working fluid 29 and the elevated temperature waste fluid 27 resulting in a relatively lower temperature waste fluid 31 exiting the heat exchanger 20. In one embodiment, the relatively lower temperature working fluid 29 and the elevated temperature waste fluid 27 are in a counter-flow configuration in the preheater 28. In a presently contemplated embodiment, the working fluid 14 is a hydrocarbon. Non-limiting examples of the hydrocarbon include at least one selected from a group of cyclopentane, n-pentane, propane, butane, n-hexane, and cyclohexane. In another embodiment, the heat source includes an exhaust of a gas turbine. In yet another embodiment, the waste heat fluid is in a gaseous state.

Figure 2:
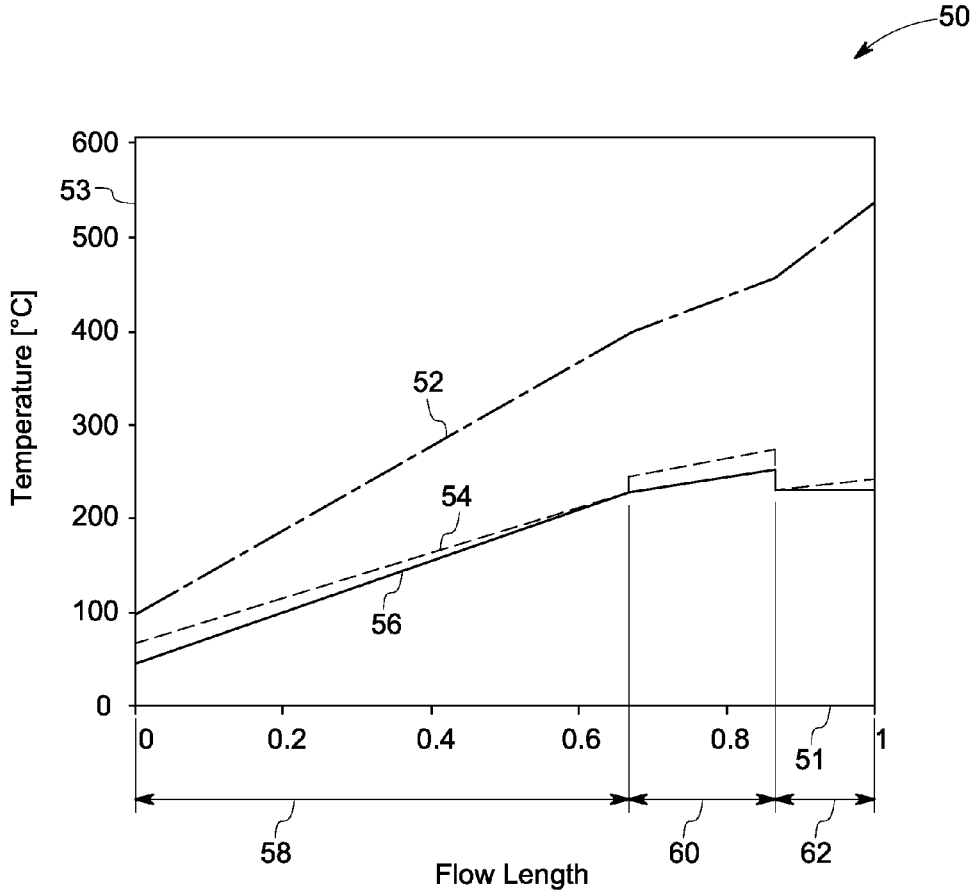
FIG. 2 is a graphical illustration of temperatures of the working fluid within a heat exchanger employing the ORC system in FIG. 1.

FIG. 2 is a graphical illustration 50 of temperatures 52 of a waste heat fluid, the film temperatures 54 of a working fluid, and bulk temperatures 56 of the working fluid in the preheater, evaporator and superheater sections of a heat exchanger employing the flow arrangement in FIG. 1. The graphical illustration 50 is a result of simulation. X-axis 51 represents flow length as a fraction of the total length of the heat exchanger, while Y-axis 53 represents temperatures in deg C. As illustrated, temperatures 52 of the waste heat fluid increases from about 100 deg C. at minimal flow length at the preheater section 58 to about 510 deg C. at a flow length of 1 unit at the superheater 62 section. Similarly, the film temperatures 54 of the working fluid in contact with the waste heat fluid increase from about 80 deg C. at preheater 58 to vary between about 244 deg C. to about 273 deg C. in the evaporator 60, and further to reach a temperature of about 240 deg C. at the superheater 62, which is well below a threshold temperature of the working fluid. The bulk temperatures 56 of the working fluid also increase from about 71 deg C. in the preheater to vary between about 233 deg C. and 231 deg C. in the evaporator, and further reach a temperature of about 240 deg C. in the superheater. A narrower gap between the bulk temperature and film temperature of the working fluid, especially in the superheater section, is clearly indicative of a greater stability of the film temperature in the superheater and limiting of the temperature to a safe limit.

Figure 3:
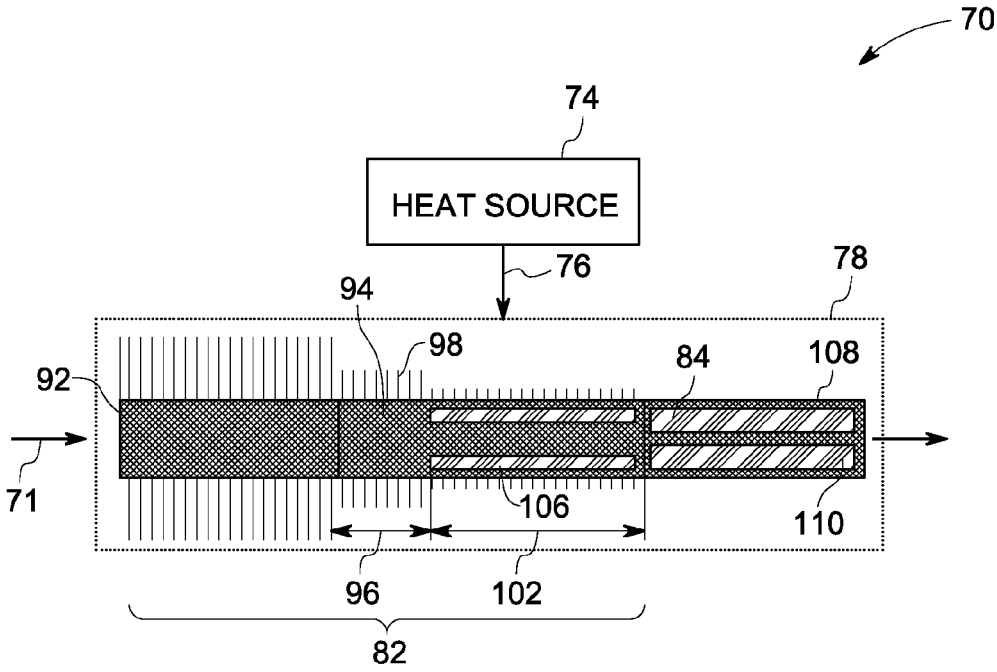
FIG. 3 is a schematic illustration of another exemplary ORC system configured to limit temperature of a working fluid below a threshold temperature in accordance with an embodiment of the invention.

FIG. 3 is a schematic illustration of another exemplary embodiment of an ORC system 70 to limit temperature of a working fluid 71 below a threshold temperature. A heat source 74 introduces waste heat fluid 76 into a heat exchanger 78. The heat exchanger 78 includes multiple external 82 and/or internal 84 enhancement features. In the illustrated embodiment, the features include fins. The external enhancement features are configured to reduce a first heat transfer coefficient between the working fluid 71 and the waste heat fluid 76, external to the heat exchanger 78. A non-limiting example of external enhancement feature includes fins. Similarly, the internal enhancement features are configured to increase a second heat transfer coefficient between the working fluid 71 and the waste heat 76, internal to the heat exchanger 78. Non-limiting examples of the internal enhancement features include internal fins, turbulators or boiling surfaces. In one embodiment, the heat exchanger 78 includes a preheater, an evaporator, and a superheater.

As illustrated herein, the working fluid 71 enters a preheater 92 in a liquid state. The preheater 92 includes fins 93 external and uniformly spaced at equal lengths relative to each other. Further, the working fluid 71 enters an evaporator 94. A portion 96 of the evaporator 94 includes fins 98 external at lengths shorter than that at the preheater 92 and uniformly spaced. A portion 102 of the evaporator includes external fins 104 and internal fins 106. The external fins 104 are at shorter lengths than that of the fins 98 and are typically uniformly spaced. The internal fins 106 are disposed to increase a first heat transfer coefficient between the working fluid 71 and the waste heat fluid 76, while reducing a wall temperature of the evaporator experienced by a film of the working fluid 71. In a particular embodiment, the first heat transfer coefficient ranges between about 3000 to about 5000 $W/m^2$-K on the fluid side, and has a value of approximately 100 $W/m^2$-K on the side of the waste heat fluid, in the embodiment in which that fluid is a gas. The area of the fins is reduced in sections of the heat exchanger 78 where the working fluid 71 is vulnerable to overheating. Similarly, in order to compensate, the area of the fins is increased in sections where the working fluid 71 is not vulnerable to overheating and to reduce a second heat transfer coefficient external to the heat exchanger 78. In an exemplary embodiment, the second transfer coefficient ranges between about 20000 to about 40000 $W/m^2$-K on the fluid side, and has a value of approximately 100 $W/m^2$-K on the side of the waste heat fluid, in the embodiment in which that fluid is a gas. Furthermore, few or no external fins are disposed in a superheater 108, while internal fins 110 may be disposed. In an exemplary embodiment, a third heat transfer coefficient, on the working-fluid side of the superheater, has a value of approximately 15000 $W/m^2$-K.

Figure 4:
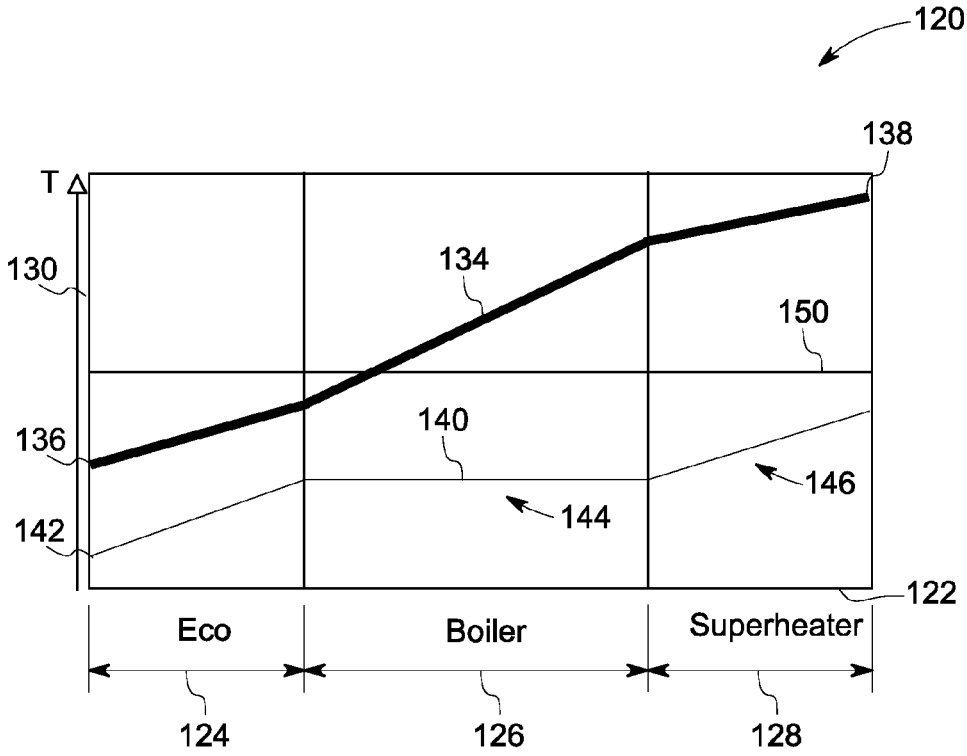
FIG. 4 is a graphical representation of temperatures of the working fluid within a heat exchanger employing the ORC system in FIG. 3.

FIG. 4 is a schematic graphical illustration 120 of exemplary temperatures of a working fluid in a preheater, evaporator and a superheater of a heat exchanger 78 (FIG. 3). The X-axis 122 represents various sections of the heat exchanger, specifically, the preheater 124 (also referred to as 'eco' in FIG. 4), evaporator 126 (also referred to as 'boiler' in FIG. 4), and superheater 128. The Y-axis 130 represents temperature in deg C. Curve 134 represents temperature of a waste heat fluid from an exhaust. The temperature at an exhaust outlet, represented by reference numeral 136, increases steeply across the preheater, evaporator and superheater at an exhaust outlet location, represented by reference numeral 138. Similarly, curve 140 represents temperature of the working fluid increasing starting from an inlet of the working fluid, represented by reference numeral 142, in a preheater 124, to reaching a steady state 144 in the evaporator 126, and further increasing slightly, as shown by 146, in the superheater 128. It should be noted that the temperature of the working fluid is maintained below a threshold temperature, indicated by horizontal line 150, in the evaporator and superheater.

Figure 5:
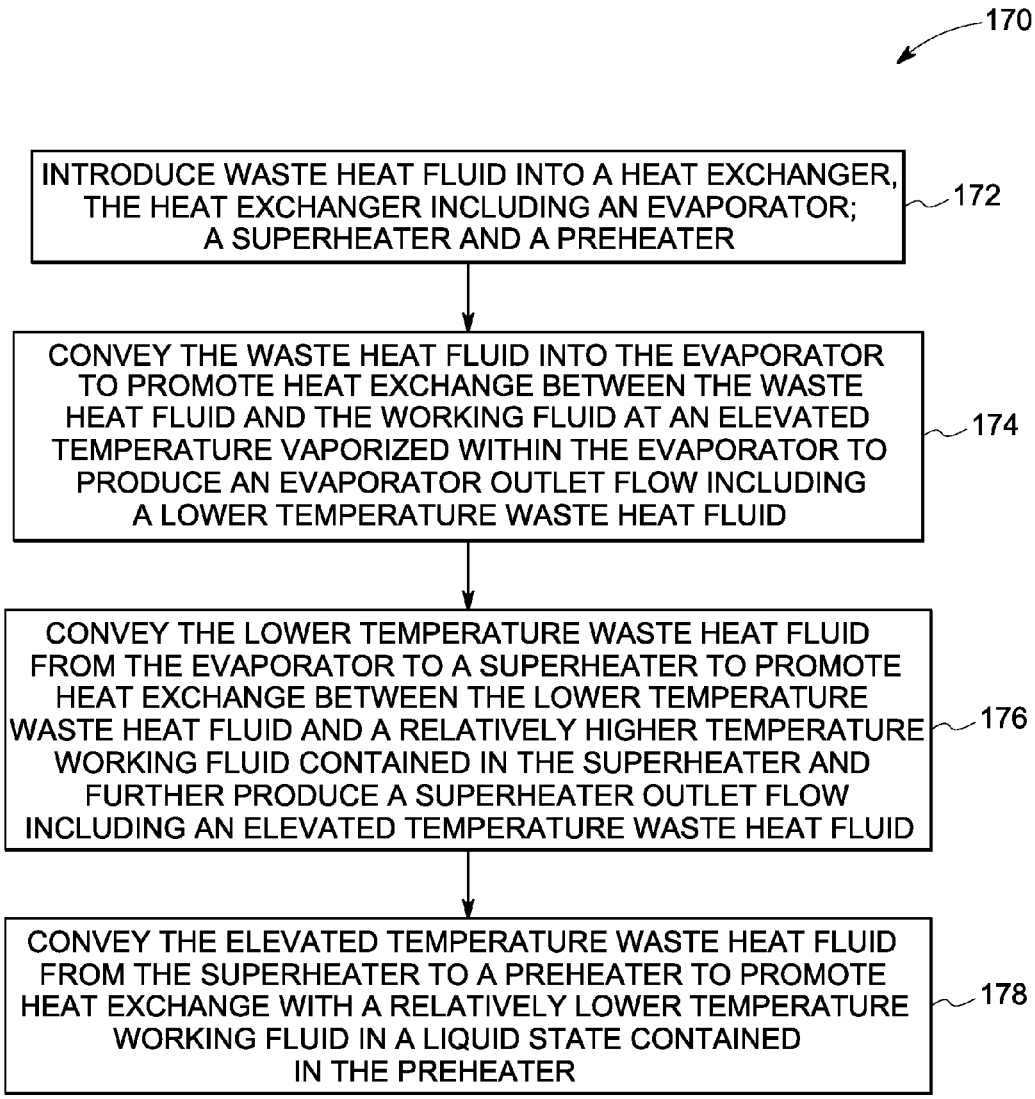
FIG. 5 is a flow chart representing steps in a method for limiting temperature of a working fluid below a threshold temperature in an ORC in accordance with an embodiment of the invention.

FIG. 5 is a flow chart representing steps in an exemplary method 170 for limiting temperature of a working fluid below a threshold temperature in an ORC system. The method 170 includes introducing waste heat fluid into a heat exchanger in step 172, wherein the heat exchanger includes an evaporator, a superheater and a preheater. The waste heat fluid is conveyed into the evaporator in step 174 to promote heat exchange between the waste heat fluid and the working fluid at an elevated temperature vaporized within the evaporator to produce an evaporator outlet flow including a lower temperature waste heat fluid. In a particular embodiment, the waste heat fluid is conveyed in a parallel flow configuration with the working fluid in the evaporator. The lower temperature waste heat fluid is then conveyed from the evaporator to a superheater in step 176 to promote heat exchange between the lower temperature waste heat fluid and a relatively higher temperature working fluid contained in the superheater and further producing a superheater outlet flow including an elevated temperature waste heat fluid. In one embodiment, the lower temperature waste heat fluid is conveyed at a temperature between about 425 to about 475 deg C. The elevated temperature waste heat fluid is further conveyed from the superheater into a preheater in step 178 to promote heat exchange with a relatively lower temperature working fluid in a liquid state contained in the preheater. In yet another embodiment, the lower temperature waste heat fluid and the elevated temperature waste heat fluid are conveyed to the superheater and the preheater respectively in a counter-flow configuration with the working fluid.

Figure 6:
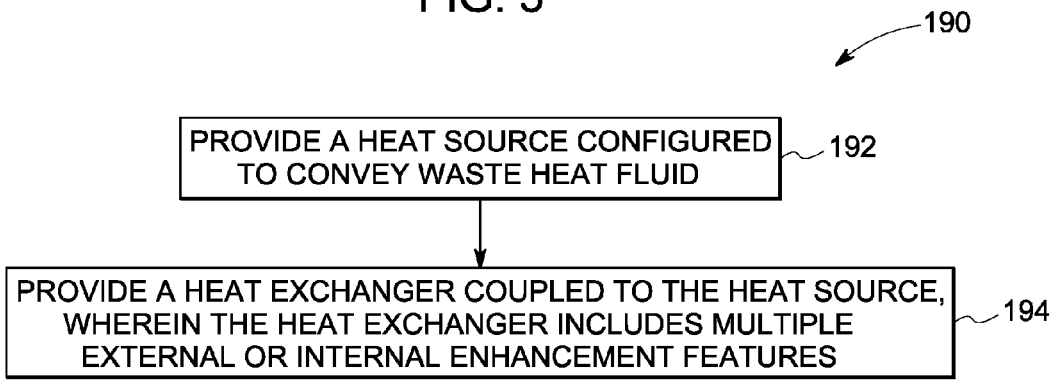
FIG. 6 is a flow chart representing steps in a method for providing an ORC system in accordance with an embodiment of the invention.

FIG. 6 is a flow chart representing steps in a method 190 for providing an organic rankine cycle system to limit temperature of a working fluid below a threshold temperature. The method 190 includes providing a heat source configured to convey waste heat fluid in step 192. A heat exchanger coupled to the heat source is provided in step 194. The heat exchanger includes multiple of at least one of external or internal enhancement features, wherein the external enhancement features are configured to reduce a first heat transfer coefficient between the working fluid and the waste heat fluid from a heat source, external to the heat exchanger. Furthermore, the internal enhancement features are configured to increase a second heat transfer coefficient between the working fluid and the waste heat fluid from a heat source, internal to the heat exchanger. In one embodiment, providing a heat exchanger includes providing at least one of a preheater, an evaporator or a superheater. In another embodiment, the external enhancement features include fins. In yet another embodiment, the internal enhancement features include fins, turbulators, and boiling surfaces.

The various embodiments of an organic rankine cycle system and method to limit temperature of the working fluid provide a highly efficient means to avoid overheating and decomposition of the working fluid. The system and method also eliminate the usage of the commonly used intermediate fluid loop thus reducing significant capital cost and complexities. The techniques also allow for a reduced footprint of a plant, permitting usage in a wide variety of applications such as, but not limited to, off-shore oil platforms, where space is at a premium.

Of course, it is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

Furthermore, the skilled artisan will recognize the interchangeability of various features from different embodiments. For example, the use of a parallel flow configuration between the working fluid and the waste heat fluid described with respect to one embodiment can be adapted for use with a heat exchanger including external enhancement features and internal enhancement features described with respect to another. Similarly, the various features described, as well as other known equivalents for each feature, can be mixed and matched by one of ordinary skill in this art to construct additional systems and techniques in accordance with principles of this disclosure.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An organic rankine cycle system configured to limit temperature of a working fluid below a threshold temperature, the organic rankine cycle system comprising:

a heat source configured to convey a waste heat fluid;

a heat exchanger coupled to the heat source, the heat exchanger comprising:

an evaporator configured to receive the waste heat fluid from the heat source and vaporize the working fluid, the evaporator further configured to promote heat exchange between the waste heat fluid and the vaporized working fluid at an elevated temperature and further produce an evaporator outlet flow comprising a lower temperature waste heat fluid;

a superheater configured to receive the lower temperature waste heat fluid from the evaporator, the superheater further configured to allow heat exchange between the lower temperature waste heat fluid and a relatively higher temperature working fluid contained in the superheater and further produce a superheater outlet flow comprising an elevated temperature waste heat fluid; and a preheater configured to receive the elevated temperature waste heat fluid from the superheater and allow heat exchange with a relatively lower temperature working fluid in a liquid state contained in the preheater.

2. The system of claim 1, wherein temperature of the waste heat fluid introduced into the evaporator comprises a range between about 450 to about 600 deg C.

3. The system of claim 1, wherein temperature of the lower temperature waste heat fluid exiting the evaporator comprises a range between about 425 to about 475 deg C.

4. The system of claim 1, wherein temperature of the working fluid exiting the evaporator comprises about 230 deg C.

5. The system of claim 1, wherein temperature of the elevated temperature waste heat fluid exiting the superheater comprises a range between about 375 to about 425 deg C.

6. The system of claim 1, wherein the preheater is configured to heat the working fluid in a liquid state.

7. The system of claim 1, wherein the waste heat fluid, the lower temperature waste heat fluid, and the elevated waste heat fluid are in a counter flow relative to the working fluid in the evaporator, superheater and the preheater respectively.

8. The system of claim 1, wherein the waste heat fluid and the working fluid are in a parallel flow configuration in the evaporator.

9. The system of claim 1, wherein the working fluid is a hydrocarbon.

10. The system of claim 9, wherein the hydrocarbon comprises at least one from a group of cyclopentane, propane, butane, n-pentane, n-hexane, and cyclohexane.

11. The system of claim 1, wherein the heat source comprises an exhaust of a gas turbine.

12. The system of claim 1, wherein temperature of the working fluid at an outlet of the preheater comprises a range between about 210 to about 250 deg C.

13. The system of claim 1, wherein the threshold temperature comprises about 300 deg C.

14. A method for limiting temperature of a working fluid below a threshold temperature in an organic rankine cycle comprising:

introducing waste heat fluid into a heat exchanger, the heat exchanger comprising an evaporator; a superheater and a preheater;

conveying the waste heat fluid into the evaporator to promote heat exchange between the waste heat fluid and the working fluid at an elevated temperature vaporized within the evaporator to produce an evaporator outlet flow comprising a lower temperature waste heat fluid;

conveying the lower temperature waste heat fluid from the evaporator to a superheater to promote heat exchange between the lower temperature waste heat fluid and a relatively higher temperature working fluid contained in the superheater and further producing a superheater outlet flow comprising an elevated temperature waste heat fluid; and conveying the elevated temperature waste heat fluid from the superheater to a preheater to promote heat exchange with a relatively lower temperature working fluid in a liquid state contained in the preheater.

15. The method of claim 14, wherein said conveying a waste heat fluid into the evaporator comprises conveying the waste heat fluid in a parallel flow with the working fluid in the evaporator.

16. The method of claim 14, wherein said conveying comprises conveying the lower temperature waste heat fluid from the evaporator into the superheater at a temperature between about 425 to about 475 deg C.

17. The method of claim 14, wherein said conveying comprises conveying the elevated waste heat fluid from the superheater into the preheater at a temperature between about 375 to about 425 deg C.

18. The method of claim 14, wherein said conveying comprises conveying the lower temperature waste heat fluid and the elevated temperature waste heat fluid to the superheater and the preheater respectively in a counter-flow configuration with the working fluid.

* * * * *